United States Patent [19]

Hori

[11] Patent Number: 4,509,876

[45] Date of Patent: Apr. 9, 1985

[54] WRITING INSTRUMENT WITH OVERFLOW CHAMBER AND RETURN TO SUPPLY

[75] Inventor: Jiro Hori, 2-202, Glorious Manshions, 33-40, 3 chome Senbacho, Kawagoe-shi, Saitama-ken, Japan

[73] Assignees: Kotobuki & Co., Kyoto; Jiro Hori, Saitama, both of Japan

[21] Appl. No.: 504,314

[22] Filed: Jun. 14, 1983

[30] Foreign Application Priority Data

Jun. 15, 1982 [JP] Japan ..... 57-102476

[51] Int. Cl.[3] ..... B43K 7/08; B43K 7/10; B43K 5/18

[52] U.S. Cl. ..... 401/217; 401/151; 401/209; 401/224; 401/225; 401/229; 401/230

[58] Field of Search ..... 401/217, 224, 225, 230, 401/242, 223, 229, 209, 151

[56] References Cited

U.S. PATENT DOCUMENTS

| | | | |
|---|---|---|---|
| 2,921,558 | 1/1960 | von Platen | 401/224 |
| 3,905,709 | 9/1975 | Bok | 401/223 X |

FOREIGN PATENT DOCUMENTS

| | | | |
|---|---|---|---|
| 42-7164 | 3/1967 | Japan . | |
| 152699 | 12/1955 | Sweden | 401/223 |
| 722177 | 1/1955 | United Kingdom | 401/230 |
| 1164745 | 9/1969 | United Kingdom | 401/217 |

*Primary Examiner*—Steven A. Bratlie
*Attorney, Agent, or Firm*—Sherman & Shalloway

[57] ABSTRACT

A writing instrument of an extremely simple structure in which stored ink previously extruded upon increase of the internal pressure of an ink chamber is subsequently sucked up by decrease of the internal pressure of the ink chamber and returned to the ink chamber, thereby preventing the outputting of ink drops in a downward orientation of pen, particularly when a large amount of ink is stored.

10 Claims, 34 Drawing Figures

WRITING INSTRUMENT WITH OVERFLOW CHAMBER AND RETURN TO SUPPLY

BACKGROUND OF THE INVENTION

The present invention relates to a writing instrument which employs a low viscosity ink such as a water-base ink.

Writing instruments using a low viscosity ink are provided with a pen member and an ink chamber, and are constructed such that the pen member and the ink chamber are interconnected through an ink passage for supply of ink in the ink chamber to the pen member; air in an amount equal to the amount of ink consumed is introduced into the ink chamber to thereby control the outflow of ink; and the ink extruded upon increase of the internal pressure of the ink chamber is stored in a storage portion and this stored ink is later consumed for writing to thereby prevent the ink from jetting to the exterior. As a typical example of such construction, there is known such a pen core mechanism of a fountain pen as disclosed in Japanese Patent Publication No. 7164/1967, in which when ink is extruded into a cavity portion of a pen core formed as an ink storage portion upon increase of the internal pressure of an ink chamber (ink tube), the ink stored in the cavity is only consumed by writing, and even when the internal pressure of the ink chamber (ink tube) decreases in a downwardly held state of pen, the above stored ink does not return to the ink chamber side because air enters the ink chamber through an air channel.

When ink stored in the above cavity is consumed, it is rarely the case that all the stored ink in the cavity is exhausted in a single writing use. Actually, ink remains in the above cavity in many cases. For example, in the case of a fountain pen having an ink chamber of 1 cc. or so, consumption of the total amount (1 cc.) of ink requires a writing distance of 500 to 1000 m. Consequently, assuming that about 10%, i.e. 0.1 cc., of ink was stored at a time within the above cavity at a temperature variation of 30° C., its exhaustion by writing requires 50 to 100 m writing. Usually, however, the writing length with a fountain pen is shorter than 1 m, so in many cases ink always remains within the above cavity.

Therefore, with the conventional fountain pen based on the idea that the stored ink is exhausted by a writing use, ready for the next increase of the internal pressure, there occurs a case where ink is newly extruded upon the next increase of the internal pressure while the stored ink remains in the pen core cavity. If this occurs many times due to repeated temperature variations, the amount of stored ink gradually increases, resulting in leakage of ink, so-called ink drops. Particularly when a writing instrument is used for an automatic drawing machine or for a recorder, the aforementioned ink drops are symptomatic of a serious defect because the pen nib is always held in a downward state.

SUMMARY OF THE INVENTION

The present invention has been accomplished in view of the above-mentioned circumstances. It is a first object thereof to provide a writing instrument of an extremely simple structure in which stored ink extruded upon increase of the internal pressure of an ink chamber is sucked up by decrease of the internal pressure of said ink chamber and returned to the ink chamber, thereby preventing the occurrence of ink drop in a downward state of pen and particularly when a large amount of ink is stored. The second object is to provide a writing instrument of a novel structure capable of preventing leakage of ink in any direction, in which no matter in which direction the writing instrument is held or left standing (e.g. upward state of pen, sideways state of pen, etc.), the above stored ink is sure to be returned to the ink chamber by decrease of the internal pressure of the ink chamber.

For achieving the above first object, the writing instrument using a low viscosity ink according to the present invention is characterized in that an ink occluding member having a strong capillary action is disposed inside a pen mounting portion of a body of the writing instrument so that it is connected with the pen member for communication of ink therewith; in that a bottomed cylindrical partition tube having an opening portion, a bottom wall side and an inner cavity is fitted and fixed into the body while leaving a fine gap with respect to the inner wall surface of the body which fine gap has a strong capillary action, the opening portion being in abutment with the ink occluding member, the bottom wall side being stoppered as a partition wall for the ink chamber of the body, and the inner cavity serving as a storage chamber for jet ink at the time of increase of the internal pressure of the ink chamber; in that an air-liquid exchange passage connecting in communication with the above mentioned fine gap between the ink chamber and the ink occluding member is formed between the partition tube and the inner wall surface of the body (the air-liquid exchange passage having a valve action adapted to be normally closed with ink and opened automatically upon ink being sucked thereout when writing to form an air passage); and in that an air intake tube is provided in the body of the writing instrument which air intake tube opens in a position not blocked by the jet ink stored in the inner cavity of the partition tube. Further, the writing instrument for achieving the foregoing second object of the present invention is characterized in that, in the writing instrument of the above-described first invention, a return passage for the stored jet ink is provided in the bottom wall portion of the partition tube or in a peripheral side portion thereof adjacent to such bottom wall portion, which return passage functions to prevent the air in the inner cavity of the partition tube from entering the ink chamber by being normally closed with ink and also functions to return the stored jet ink which has entered the inner cavity of the partition tube upon increase in internal pressure of the ink chamber of the body to the ink chamber side in upward and sideways states of pen at the time of decrease of the internal pressure of the ink chamber.

DESCRIPTION OF THE PREFERRED EMBODIMENT

Figure 1:
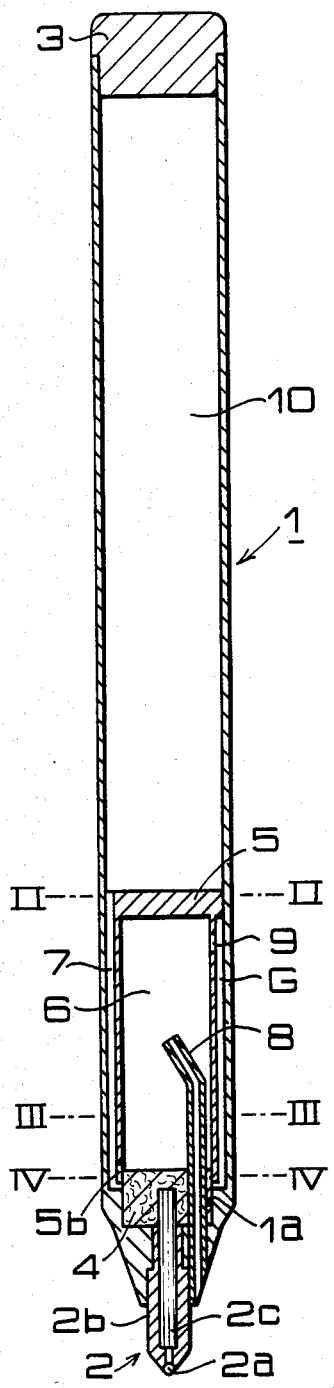
FIG. 1 is a longitudinal sectional view of a writing instrument according to a first embodiment of the present invention, not filled with ink yet.
Figure 2:
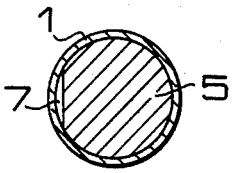
FIGS. 2, 3 and 4 are transverse section views taken along lines II—II, III—III and IV—IV of FIG. 1.
Figure 3:
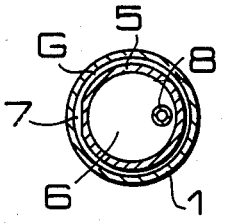
Figure 4:
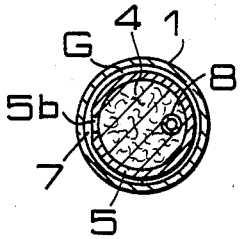
Figure 6:
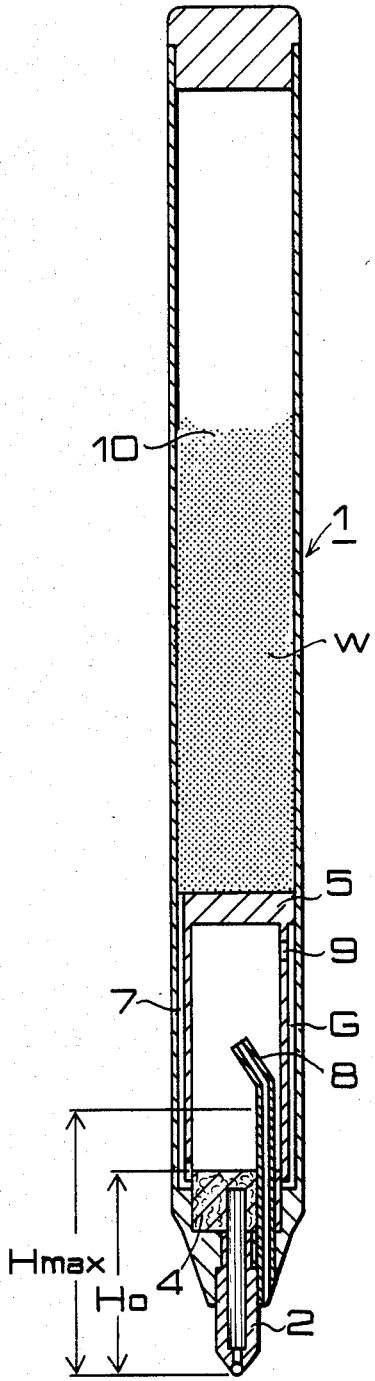
FIGS. 6 through 9 are sectional views corresponding to FIGS. 1 through 4, showing a state of ink being filled in a body of the writing instrument.
Figure 5:
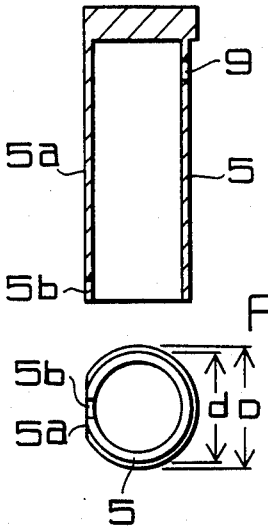
FIG. 5 is an explanatory view showing the structure of a partition tube in terms of sectional and bottom views.
Figure 7:
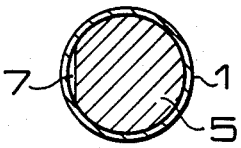
Figure 8:
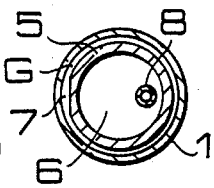
Figure 9:
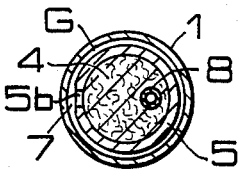
Figure 17:
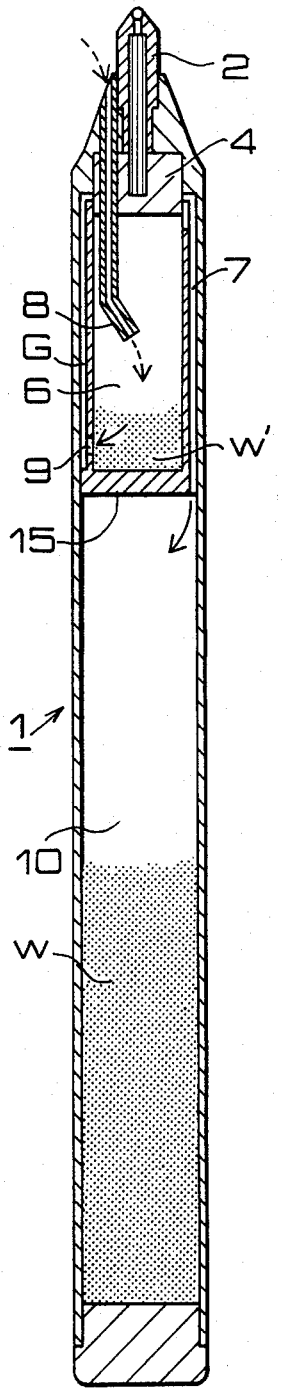
Figure 20:
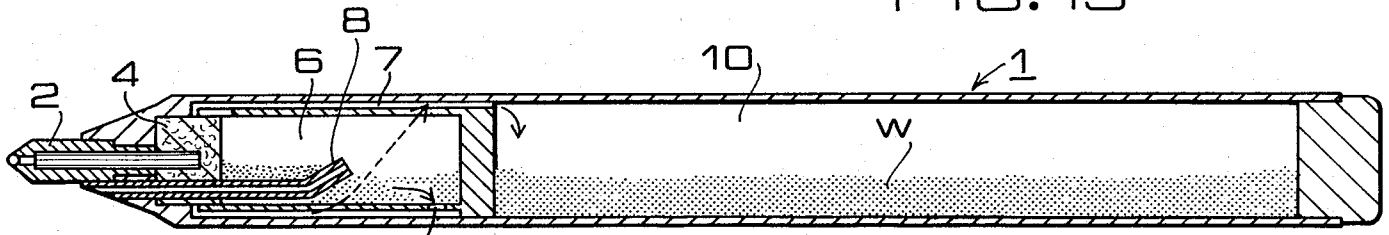

Embodiments of the present invention will now be described with reference to the drawings. FIG. 1 is an embodiment of the invention applied to a hand-writing instrument, showing in terms of a centrally longitudinal sectional view a state before use with ink (a low viscosity ink) not inserted yet. FIGS. 2, 3 and 4 are transverse sectional views of portions along lines II—II, III—III and IV—IV in FIG. 1. In these figures, a writing instrument body indicated by the reference numeral 1 is formed as an elongated shaft tube of a circular section, with a pen member 2 being attached to the fore end thereof, while a tail stopper 3 is removably sealed in an opening at the rear end of the writing instrument body. The pen member 2 is composed of a ball holder **2*b* which holds a ball 2*a* rotatably and which is fitted in a fore-end hole of the writing instrument body 1, and an ink relay core (fiber-bundle core) 2*c* which is inserted in a central hole communicating with the ball holding portion of the ball holder 2*b* and which projects inwards from the rear end of the holder. Other than such a ball pen tip type pen member, there also may be used a fibrous pen member, a porous plastic pen member, a pipe pen member or the like having a capillary action strong enough to draw out ink to the writing end. The numeral 4 designates an ink occluding member inserted in an inside bore 1*a* of a pen member mounting portion of the writing instrument body. The ink relay core 2*c* of the pen member 2 is inserted in a central hole of the ink occluding member 4, and this member 4 is connected with the relay core 2*c* of the pen member for communication of ink. For the ink occluding member 4 an ink absorbing material is used having a strong capillary action capable of preventing the dropping of ink by virtue of the capillary action, adsorptivity, adhesive force, etc. after absorption of ink up to a state of saturation. The numeral 5 denotes a bottomed cylindrical partition tube fitted and fixed in an internal position of the fore end side of the writing instrument body 1. The partition tube 5 has an opening portion at the fore end thereof the inside of which is in abutment with the ink occluding member 4, a bottom portion which serves as a partition wall for an ink chamber 10 of the body and which is in close contact with the inner wall surface of the body, and an inner cavity 6 which serves as a jet ink storage chamber. The outside diameter d of a cylindrical portion of the partition tube 5 is somewhat smaller than the outside diameter D of the bottom portion (inside diameter of the body) to form a fine gap G of about 0.05 mm throughout the entire periphery of the fitting portion with respect to the inner wall surface of the body, the fine gap G having a strong capillary action (but a little weaker than that of the ink occluding member 4). Further, on an outside surface of the partition tube 5 is formed a notched circumferential plane 5*a* by cutting a part of the circumference of the tube throughout the overall length. A bore (a generally crescent-shaped bore having a strong capillary action on both side portions and a weak capillary action at the central portion) is defined by being surrounded with the notched circumferential plane 5*a* and the inner wall surface of the body, and by this bore is formed an air-liquid exchange passage 7 which connects between the ink chamber 10 of the body and the ink occluding member 4. The air-liquid exchange passage 7 opens in the vicinity of the ink occluding member 4 in the inner cavity 6 of the partition tube through a notched groove 5*b* which has a width smaller than that of the foregoing passage formed in the fore-end opening of the partition tube 5. The numeral 8 denotes an air intake tube disposed in the fore end portion of the writing instrument body. The air intake tube 8 projects through a part of the ink occluding member 4 into the inner cavity 6 of the partition tube, and its inward projecting portion is bent and opens in a central position with respect to both the radial and longitudinal directions of the inner cavity 6 so that an opening portion at the tube end may not be blocked with the stored jet ink in the inner cavity, as shown in FIG. 1. The numeral 9 denotes an ink return passage comprising a small hole which opens in a circumferential side portion of the partition tube 5 near the bottom wall of the partition tube 5 and on the side opposite to the air-liquid exchange passage 7 (the notched circumferential plane 5*a* of the partition tube 5*a*), the ink return passage being in communication with the foregoing fine gap G. The return passage 9 is normally closed with the ink filled in the fine gap G to prevent the air in the inner cavity 6 of the partition tube from entering the ink chamber 10 of the body through the return passage 9, as shown in FIGS. 6, 14 and 15, and it functions to return the stored ink in the inner cavity 6 of the partition wall (the ink jets into the inner cavity 6 of the partition tube upon increase in internal pressure of the ink chamber 10 of the body) to the body ink chamber 10 side upon decrease of the internal pressure of the body ink chamber 10 in such an upward state of the pen as shown in FIG. 17 and also in such a sideways state of the pen as shown in FIG. 20**.

Figure 10:
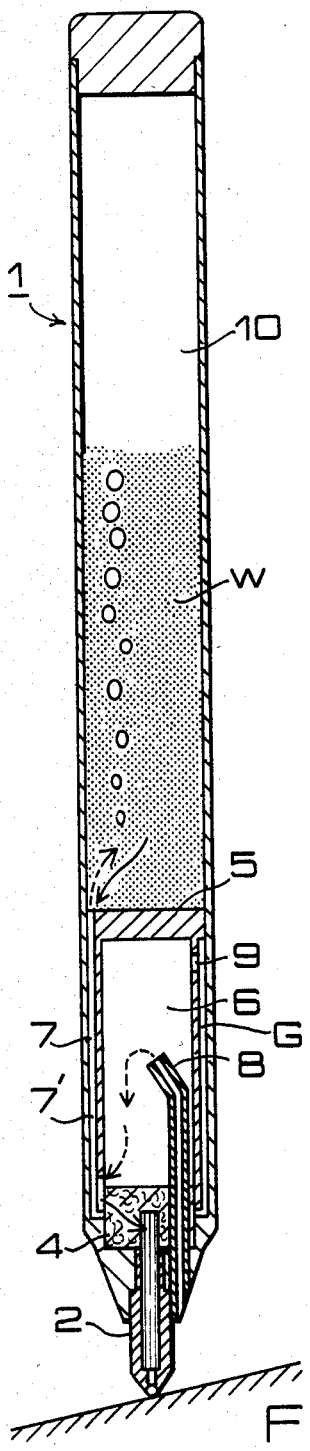
FIGS. 10 through 13 are sectional views corresponding to FIGS. 1 through 4, showing a state of air-liquid exchange in writing.
Figure 11:
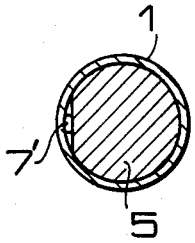
Figure 12:
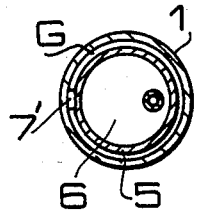
Figure 13:
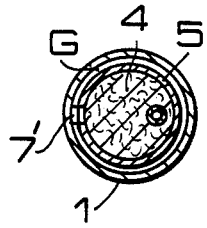

FIGS. 6 through 9 are explanatory views (corresponding to FIGS. 1 through 4 with indication of ink) showing states of use with a low viscosity ink W being charged into the body ink chamber 10. In this state, part of the ink W in the body ink chamber 10 is drawn out to the ink occluding member 4 and pen member 2 side by virtue of capillary action, and the air-liquid exchange passage 7 and the return passage 9 are closed with the ink filled in the air-liquid exchange passage 7 and in the fine gap G; further, the ink occluding member 4 absorbs ink up to a saturated state and prevents the dropping of ink by virtue of its capillary action, adsorptivity and adhesive force. That is, when the ink occluding member 4 absorbs ink W up to saturated state by virtue of capillary action, the ink weight and the internal pressure balance and become stable. At this time, ink heads associated with ink leakage are at $H_o$ when the inner cavity 6 of the partition tube is empty, and $H_{max}$ when ink is extruded into the inner cavity 6 of the partition tube as shown in FIG. 14. Although the ink heads differ in dependence upon the structure and material of the pen member 2 and the ink occluding member 4, in case the ink member 2 is such a ball pen member as shown and the ink occluding member 4 is an acrylic fiber bundle, the ink head $H_{max}$ is allowed up to about 25 mm, and in order that the ink head $H_{max}$ may be held within this allowable range, if the capacity of the body ink chamber 10 and that of the inner cavity of the partition tube are $V_1$ and $V_2$, respectively, and $V_2$ is set with a margin not less than twice the expanding capacity of $V_1$, the ink head from the inner cavity of the partition tube up to the tip end of the pen member, including the ink which has entered the inner cavity of the partition tube, does not exceed about 25 mm, therefore the ink neither drops from the pen member nor does it flow out to the exterior from the air intake tube. When the ink absorbed in the ink occluding member 4 up to a saturated state is consumed by writing with the pen member 2, a superfluous power for absorbing ink is produced in the ink occluding member 4, which therefore soaks in the ink present in the fine gap G and that present in the air-liquid exchange passage 7, whereby the ink at the central portion of the air-liquid exchange passage 7 which portion is weak in capillary action is soaked in to form an air inflow passage 7' at the said central portion of the passage as shown in FIGS. 11 through 13. The air in the inner cavity 6 of the partition tube passes through the air inflow passage 7' into the body ink chamber 10 as shown in FIG. 10, and thus an air-liquid exchange is performed between the air and the ink. When the ink occluding member 4 again assumes a saturated state with the absorbed ink, the open air-liquid exchange passage 7 (air inflow passage 7') as shown in FIGS. 10 through 13 is closed automatically with ink as shown in FIGS. 6 through 9 to stop both entry of air into the ink chamber 10 and supply of ink to the ink occluding member 4. FIG. 14 shows a state of increase in internal pressure of the body ink chamber 10 in a downward state of pen. In this state, the ink W in the ink chamber 10 is extruded through the air-liquid exchange chamber 7 into the inner cavity 6 of the partition tube, and the air in the internal cavity in an amount corresponding to the amount of this jetted storage ink W' is discharged to the exterior through the air intake tube 8. At this time, even if the ink occluding member 4 assumes a saturated state, it holds ink without dropping from the tip end of the pen because the ink head up to the tip end of the pen is small, thus allowing the ink extruded from the ink chamber 10 to be introduced into the inner cavity of the partition tube. Consequently, the dropping of ink from the pen member 2 caused by an increase of the internal pressure of the ink chamber 10 is sure to be prevented.

Figure 14:
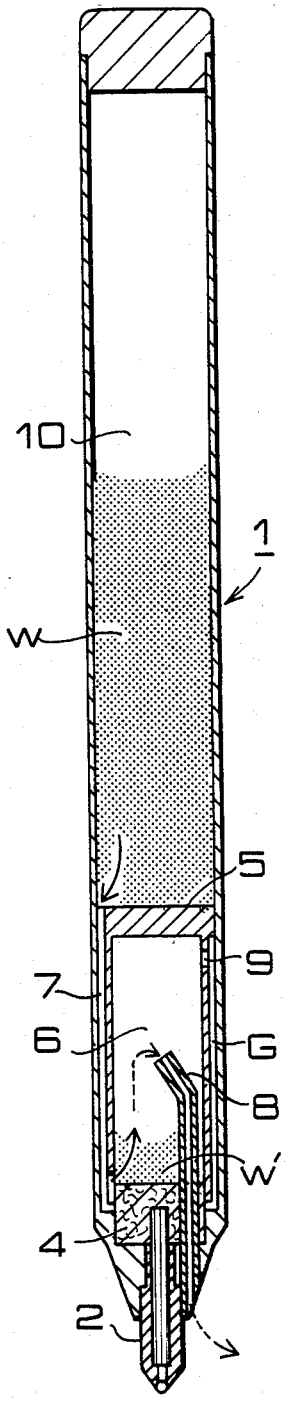
FIGS. 14 and 15 are views illustrative of operations in both cases of increase and decrease of internal pressure in a downward state of pen.
Figure 15:
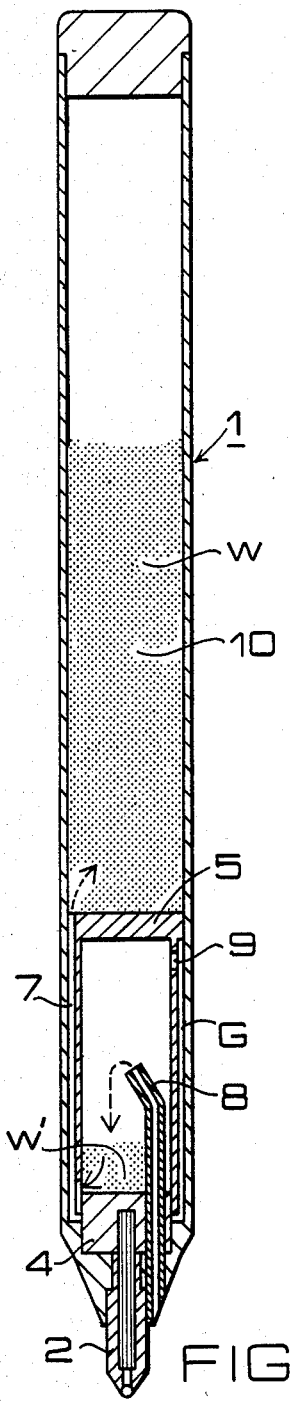

FIG. 15 shows a state in which the ink W' stored as in FIG. 14 is returned to the ink chamber 10 side in a downward state of pen as a result of decrease of the internal pressure of the body ink chamber 10. In this case, upon decrease of the internal pressure of the body ink chamber 10 as a result of a temperature drop, the stored jet ink W' in the inner cavity 6 of the partition tube is sucked up through the air-liquid exchange passage 7 into the ink chamber 10, and the outside air in turn flows into the inner cavity 6 of the partition tube through the air intake tube 8. At this time, the ink return passage 9 is closed with the ink in the fine gap G having a strong capillary action, so the stored ink W' can be sucked up efficiently into the ink chamber 10 while preventing the entry of air into the ink passage of the partition tube inner cavity 6.

Figure 16:
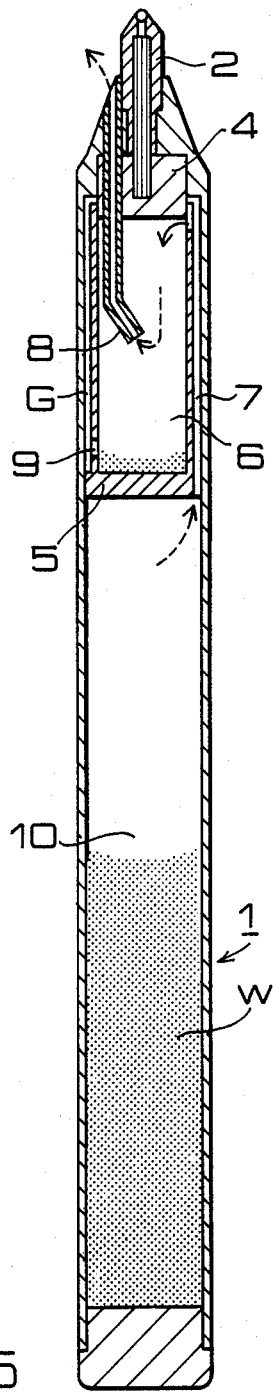
FIGS. 16 and 17 are views illustrative of operations in both cases of increase and decrease of internal pressure in an upward state of pen.

FIG. 16 shows a state of an increase in internal pressure of the ink chamber 10 in an upward state of the pen. At this time, the ink in the air-liquid exchange passage 7 is extruded into the partition tube inner cavity 6, and the air-liquid exchange passage 7 opens as an air hole, and the internal pressure escapes to the exterior along the route of this air hole→partition tube inner cavity 6→air intake tube 8, therefore the problem of ink leakage from the pen member 2 does not occur.

Figure 19:
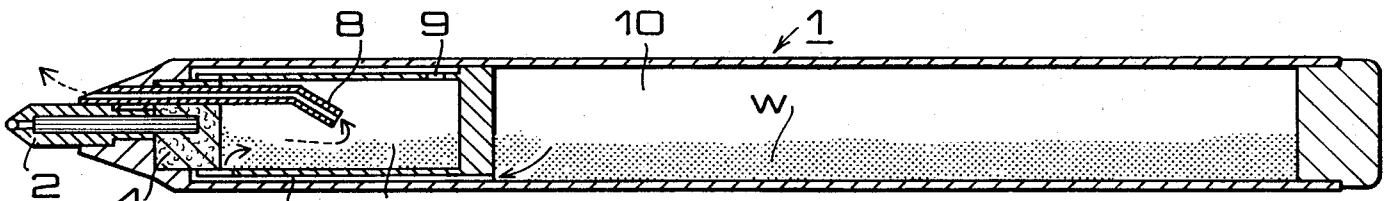

FIG. 17 shows a state in which the stored ink W' in the partition tube inner cavity 6 (ink which has flowed in in such a downward state of pen as in FIG. 14 or ink which has flowed in in such a sideways state of ink as in FIG. 19) is returned to the ink chamber 10 side by decrease of the internal pressure of the ink chamber 10 in an upward state of pen. At this time, the ink W' stored on the bottom side of the partition tube 5 is sucked into the ink chamber 10 along the route of return passage 9→fine gap G→air-liquid exchange passage 7, and in turn the outside air flows into the partition tube inner cavity 6 through the air intake tube 8.

Figure 18:
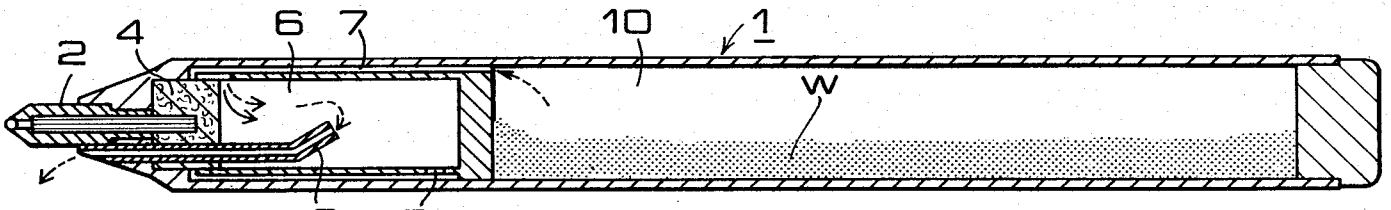
FIGS. 18 through 20 are views illustrative of operations in both cases of increase and decrease of internal pressure in a sideways state of pen.

FIGS. 18 and 19 show a state of increase in internal pressure of the ink chamber 10 in a sideways state of pen (in FIG. 18 the ink return passage 9 is positioned down and in FIG. 19 the ink return passage 9 is positioned up). In the state of FIG. 18, the ink in the air-liquid exchange passage 7 is extruded into the partition tube inner cavity 6 by increase of the internal pressure of the ink chamber 10, and the passage 7 opens as an air hole, and the internal pressure escapes to the exterior along the route of this air hole (opened air-liquid exchange passage 7)→partition tube inner cavity 6→air intake tube 8, therefore the ink leakage from the pen member 2 does not occur. In the state of FIG. 19 the ink return passage 9 is up and the air-liquid exchange passage 7 is down, therefore, part of the ink W in the ink chamber 10 is extruded into the partition tube inner cavity 6 by increase of the internal pressure of the ink chamber 10. At this time, the air in the partition tube inner cavity 6 is discharged to the exterior through the air intake tube 8. Thus, since the ink jetted by increase of the internal pressure is stored in the partition tube inner cavity 6 also in the sideways state of pen, it never leaks out from the pen member 2 or the air intake tube 8.

FIG. 20 shows a state in which the stored ink W' in the partition tube inner cavity 6 (ink which has flowed in in such a downward state of pen as in FIG. 14 or ink which has flowed in in such a sideways state of pen as in FIG. 19) is returned to the ink chamber 10 side by decrease of the internal pressure of the ink chamber 10 in a sideways state of pen. This state of FIG. 20 is a sideways state of pen with the air-liquid exchange passage 7 being positioned up and the ink return passage 9 positioned down. If in this state the internal pressure of the ink chamber 10 falls, the stored ink W' in the partition tube inner cavity 6 is returned from the return passage 9 through the fine gap G having a strong capillary action and further from the air-liquid exchange passage 7 into the ink chamber 10 (this return action is effected by a suction force induced by a decrease of the internal pressure). At this time, the air-liquid exchange passage 7 tries to open by virtue of a suction force induced by a drop in internal pressure of the ink chamber 10, but it does not open until the stored ink W' is all sucked up because the ink W' stored in the partition tube inner cavity 6 is fed continuously without letup through the fine gap G having a strong capillary action (in the event the air-liquid exchange passage 7 should open halfway, the air in the partition tube inner cavity 6 will be sucked into the ink chamber 10 through the passage opening, resulting in loss of the action of returning the stored ink W' in the inner cavity to the ink chamber 10 side).

Figure 21:
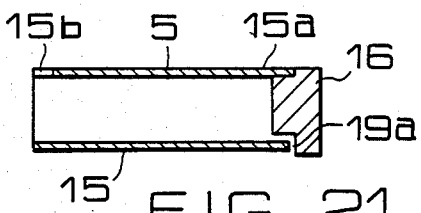
FIGS. 21 through 25 are schematic explanatory views showing different examples of partition tubes and ink return passages in terms of sectional views or both sectional and side views.
Figure 22:
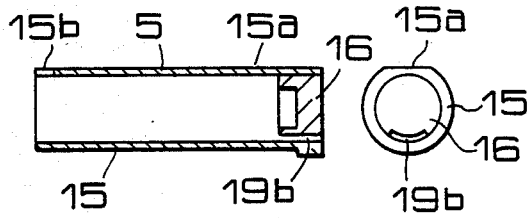
Figure 23:
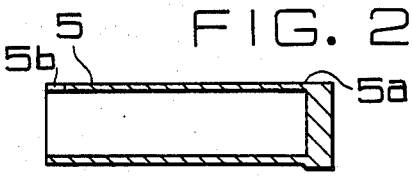

FIGS. 21 through 25 show modifications of the foregoing partition tube 5 and return passage 9 formed therein. In the cases of FIGS. 21 and 22, the partition tube 5 is composed of a cylinder 15 and a stopper 16 fitted in an opening formed at the rear end of the cylinder 15, the cylinder 15 being provided with a notched circumferential plane 15*a* formed at a peripheral side portion thereof and a notched portion 15*b* at a tube end. In the fitting portion of the stopper 16 and cylinder 15 there are formed fine openings 19*a* and 19*b* in positions opposite to the notched circumferential plane 15*a*, the fine openings 19*a* and 19*b* serving as the return passage 9 for the stored ink W'. FIG. 23 shows a modification where the partition tube 5 is not provided with the ink return passage 9, which modification is applied to writing instruments with pen being used always in a downwardly held state (writing instruments for automatic drawing machines, for recorders, etc.).

Figure 24:
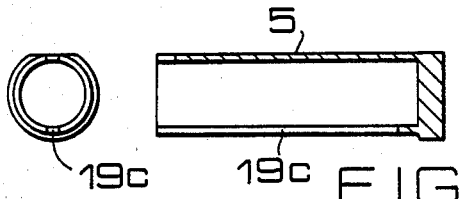
Figure 25:
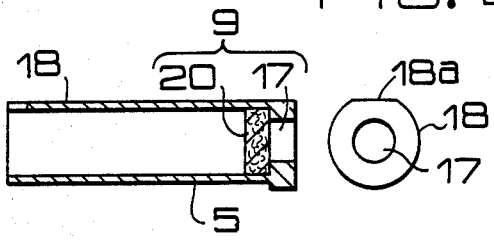
Figure 27:
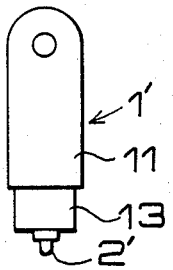
Figure 28:
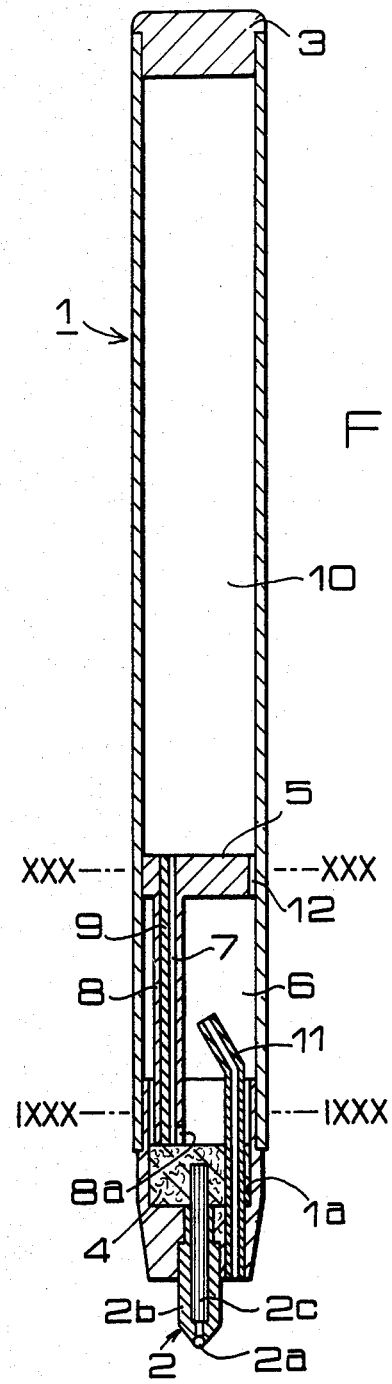
FIG. 28 is a longitudinal sectional view of a writing instrument according to a still further embodiment of the present invention, not yet filled with ink.
Figure 29:
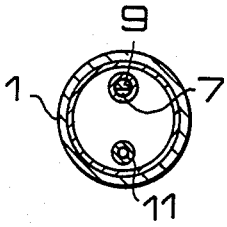
FIGS. 29 and 30 are transverse sectional views taken along lines IXXX—IXXX and XXX—XXX of FIG. 28.
Figure 30:
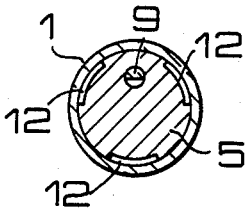
Figure 31:
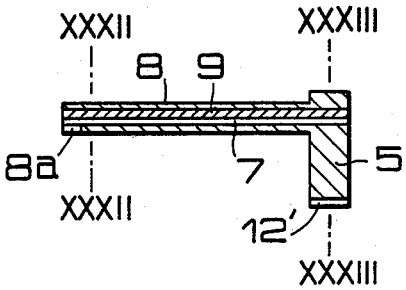
FIG. 31 is a longitudinal sectional view showing constituent members of a body partition and an air-liquid exchange passage.

FIG. 24 shows a modification in which the foregoing return passage 9 is constituted by a slit-like channel 19*c* formed by cutting from the opening end of the partition tube up to near the bottom wall portion on the side opposite to the notched circumferential plane 5*a* of the partition tube 5. FIG. 25 shows a modification in which the partition tube 5 is composed of a cylinder 18 having an opening 17 formed in the bottom wall thereof (with a notched circumferential plane 18*a* which forms the air-liquid exchange passage 7 being formed at a peripheral side portion of the cylinder), and a plug member 20 formed of a fibrous or porous material having a strong capillary action adapted to absorb the ink which blocked the opening 17 of the cylinder bottom wall, but allow the absorbed ink to cut off the passing of air therethrough, with the return passage 9 of the stored ink W' to the body ink chamber 10 being formed by the plug member 20 and the opening 17 in the cylinder bottom wall.

Figure 26:
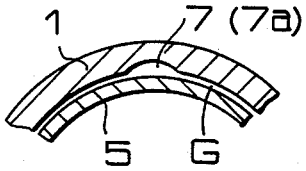
FIG. 26 is a sectional view of a principal portion showing a modification of an air-liquid exchange passage.

FIG. 26 is an enlarged sectional view of a principal portion showing another example of the foregoing air-liquid exchange passage 7, in which the air-liquid exchange passage 7 is constituted by one or plural passage channels 7*a* having a strong capillary action on both sides and a weak capillary action at its central portion, the passage channels 7*a* being formed in the inner wall surface portion of the writing instrument body 1 in which is fitted the partition tube 5.

Figure 27:
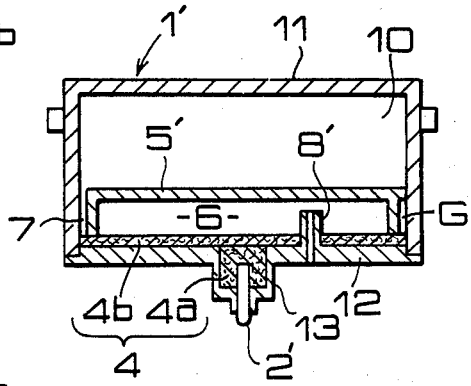
FIG. 27 shows another embodiment of the present invention applied to a writing instrument for a recorder, in which (A) is a centrally longitudinal sectional view and (B) is a right side view.

FIGS. 27(A) and (B) show an embodiment of the present invention applied to a writing instrument for a recorder with the pen member 2 being used always in a downward state, in which a writing instrument 1' having an ink chamber 10 of a large capacity is composed of a housing 11 and a closure member 12 which closes a lower-end opening of the housing 11. A pen member 2' is fitted in a centrally projecting port 13 of the closure member 12, and an ink occluding member 4 having a strong capillary action for supplying ink to the pen member 2' is composed of a first ink occluding member 4*a* accommodated in the interior of the centrally projecting port 13 of the closure member and a second ink occluding member 4*b* disposed on the inside surface of the closure member 12 in face-to-face contact with the first occluding member 4*a*. Further, inside the writing instrument body 1' is fitted and fixed a partition tube 5' in the form of a bottomed square pillar while leaving a fine gap G with respect to the inner wall surface of the housing 11. The partition tube 5' is in abutment at its opening end face with the ink occluding member 4*b*, and its bottom side is stoppered to the inner wall surface of the body housing 11 as a partition wall for the body ink chamber 10, and an inner cavity 6 communicating with the ink chamber through an air-liquid exchange passage 7 is formed as a jet ink storage chamber. In the body, closure member 12 is provided an air intake tube 8' which projects into the partition tube inner cavity 6 through the ink occluding member 4*b*. An end portion of this air intake tube opens in an upward position not blocked with the ink stored in the inner cavity 6. The operation of this embodiment is about the same as that shown in FIGS. 6 through 15 concerning the foregoing first embodiment, so its explanation is here omitted.

Figure 32:
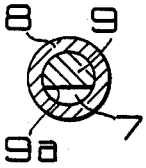
FIG. 32 is an enlarged sectional view taken on line XXXII—XXXII of FIG. 31.
Figure 33:
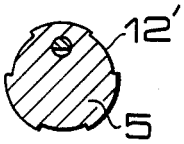
FIG. 33 is a sectional view taken on line XXXIII—XXXIII of FIG. 31.

FIGS. 28 through 33 show another embodiment of the present invention, in which the numeral 5 denotes a partition which partitions the interior of the body 1 into an empty chamber 6 of a small capacity and an ink chamber 10 of a large capacity. The partition 5 is constituted by a disc-like synthetic resin part fitted and fixed within the body 1 in an inner position spaced from the ink occluding member 4. The numeral 7 denotes an air-liquid exchange passage extending through the partition 5 and connecting for communication of ink between the ink chamber 10 and the ink occluding member 4. As to the passage 7, a core bar 9 is inserted into a pipe 8 of a small diameter which projects integrally from the partition 5 and which has an opening at the fore end thereof, the opening being in abutment with the ink occluding member 4, and the passage 7 is formed as in FIG. 32 as a bore of a generally D-shaped section surrounded by a notched outer peripheral plane 9*a* of the core bar 9 and the inner wall surface of the pipe 8. The numeral 8*a* denotes a notched portion formed in the fore end of the pipe 8, which allows the air-liquid exchange passage 7 and the empty chamber 6 to communicate with each other in the vicinity of the ink occluding member 4 so that air can be introduced. The numeral 11 denotes an outside air intake tube provided in the fore end of the writing instrument body. The air intake tube 11 projects into the empty chamber 6 through the outer peripheral portion of the ink occluding member 4, and its projecting inner portion is bent and opens in a central position with respect to both radial and longitudinal directions of the empty chamber 6 so that its inner open end may not be blocked with the stored jet ink extruded into the empty chamber 6. The numeral 12 denotes a stored ink return passage which comprises one or plural (three in the illustrated embodiment) fine openings having a strong capillary action provided between the partition 5 and the inner wall surface of the body 1. The return passage 12 is formed by providing such notches 12' as shown in FIGS. 32 and 33 in the outer periphery of the partition 5. The stored ink return passage 12 formed by such notches is blocked with ink held by a strong capillary action thereby preventing the air in the empty chamber 6 from entering the ink chamber 10 through the passage 12, but functions to return the stored ink in the empty chamber 6 (the ink jets into the empty chamber 6 upon increase of the internal pressure of the ink chamber 10) to the ink chamber 10 side when the internal pressure of the ink chamber 10 decreases in a sideways state of pen.

Since the writing instrument of the present invention is constructed as hereinabove described, it is possible to store the ink which has been extruded upon increase of the internal pressure of the ink chamber in the inner cavity of the partition tube for a while and return all of this stored ink to the ink chamber upon decrease of the internal pressure which follows the increase of the internal pressure. Consequently, it is possible to obtain a writing instrument of an extremely simple structure not causing leakage of ink from the pen member side even in storage of a large volume of ink.

Particularly in the case of the writing instrument according to the second invention, the above-mentioned effect can be attained no matter in which direction the pen is held, including upward and sideways directions, and therefore it exhibits a superior effect in practical use as a writing instrument for hand writing.

What is claimed is:

1. A writing instrument using a low viscosity ink, comprising an ink occluding member having a strong capillary action, said ink occluding member being disposed inside a pen member mounting portion of a body of said writing instrument so that it is fluidly connected with said pen member for communication of ink therewith; a partitioning portion disposed in an inner position spaced from said ink occluding member for partitioning the interior of the body into an empty chamber of a small capacity and an ink chamber of a large capacity; an air-liquid exchange passage connecting for communication of ink between said ink chamber and said ink occluding member through said partitioning portion, said air-liquid exchange passage being normally closed with ink and adapted to open upon the sucking out of ink when writing, said air-liquid exchange passage having both strong and weak capillary actions; a notched portion formed in a fore end of said air-liquid exchange passage for communication between said passage and said empty chamber in the vicinity of said ink occluding member so that air can be introduced; an air intake tube disposed in the fore end of said writing instrument body for introducing outside air into said empty chamber, with an inner open end of said air intake tube being positioned so as not to be blocked with the stored jet ink extruded into said empty chamber; and further including at least one ink return passage between said empty chamber and said ink chamber having a strong capillary action, said ink return passage being formed between said partitioning portion and the inner wall surface of the body to thereby enable return of ink from said empty chamber to said ink chamber during sideways and inverted orientations of said writing instrument.

2. A writing instrument using a low viscosity ink, comprising an ink occluding member having a strong capillary action, said ink occluding member being disposed inside a pen member mounting portion of a body of said writing instrument so that it is fluidly connected with said pen member for communication of ink therewith; a bottomed partition tube having an opening portion, a bottom portion and an inner cavity, said opening portion being in abutment with said ink occluding member, said bottom portion comprising a partition wall for an ink chamber of said writing instrument body, said inner cavity serving as a storage chamber for ink, said partition tube being fitted into said body while leaving a fine part circumferential gap with respect to the adjacent inner wall surface of said body, said fine gap providing a strong capillary action for ink contained therein; an air-liquid exchange passage connecting in communication with said fine gap and between said ink chamber and said ink occluding member, said air-liquid exchange passage being normally closed with ink and adapted to open automatically to form an air passage upon the sucking out of ink from said pen member during writing; an air intake tube provided in said writing instrument body which air intake tube opens in said inner cavity in a position not blocked with ink stored in the inner cavity; and a return passage fluidly connecting said inner cavity with said ink chamber when said writing instrument is inverted to thereby enable ink in said inner cavity to drain into said ink chamber during inversion of said writing instrument.

3. The writing instrument as set forth in claim 2, wherein said air-liquid exchange passage comprises one or plural passage bores defined by both a notched circumferential plane formed throughout the overall length of an outside surface of said partition tube and the inner wall surface of said writing instrument body, said passage bores having a strong capillary action on both sides and a weak capillary action at central portions thereof, and said air-liquid exchange passage opening at an opening portion of said partition tube into said inner cavity through a notched portion thereof.

4. The writing instrument as set forth in claim 2, wherein said air-liquid exchange passage comprises one or plural passage channels formed in the inner wall surface portion of said writing instrument body in which portion is fitted said partition wall, said passage channels having a strong capillary action on both sides and a weak capillary action at central portions thereof.

5. The writing instrument as set forth in claim 2, wherein regarding the capillary action of said pen member, said ink occluding member, said fine gap and said air-liquid exchange passage, in the order recited, said capillary action is strongest in said pen member, less strong in said ink occluding member, weaker yet in said fine gap and weakest in said air-liquid exchange passage.

6. A writing instrument using a low viscosity ink, comprising an ink occluding member having a strong capillary action, said ink occluding member being disposed inside a pen member mounting portion of a body of said writing instrument, so that it is fluidly connected with said pen member for communication of ink therewith; a bottomed partition tube having an opening portion, a bottom portion and an inner cavity, said opening portion being in abutment with said ink occluding member, said bottom portion comprising a partition wall for an ink chamber of said writing instrument body, said inner cavity serving as a storage chamber for ink, said partition tube being fitted into said body while leaving a fine gap with respect to the inner wall surface of said body, said fine gap having a strong capillary action; an air-liquid exchange passage connecting in communication with said fine gap and between said ink chamber and said ink occluding member, said air-liquid exchange passage being normally closed with ink and adapted to open automatically to form an air passage upon the sucking out of ink when writing; an air intake tube provided in said writing instrument body which air intake tube opens in a position not blocked with the ink stored in the inner cavity of said partition tube, said partition tube further having a return passage for the stored ink, said return passage being formed in the bottom wall portion of said partition tube or in a peripheral side portion of said bottom wall portion, said return passage functioning to prevent air in the inner cavity of said partition tube from entering said ink chamber by being normally blocked with ink and also functioning to return the stored ink which has entered the inner cavity of said partition tube upon increase in internal pressure of said ink chamber of said writing instrument body to the ink chamber in inverted and sideways states of the pen upon decrease of the internal pressure of said ink chamber.

7. The writing instrument as set forth in claim 6, wherein said return passage is a small hole which opens in communication with the fine gap in a peripheral side portion of the partition tube in a position close to the bottom wall portion of the partition tube and spaced from the air-liquid exchange passage.

8. The writing instrument as set forth in claim 6, wherein said partition tube comprises a cylinder having open ends and a stopper fitted in the rear end of said cylinder, with a fine opening being formed in the engaging portion of said stopper and said cylinder in a position spaced from the air-liquid exchange passage, said fine opening serving as a return passage for the stored ink.

9. The writing instrument as set forth in claim 6, wherein said return passage is a slit-like channel formed from the opening end of the partition tube up to near the bottom wall portion thereof in a peripheral said portion of the partition tube spaced from the air-liquid exchange passage.

10. The writing instrument as set forth in claim 6, wherein said partition tube comprises a cylinder having a bottom wall portion with an opening formed therein, and a plug member formed of a fibrous or porous material having a strong capillary action adapted to absorb the ink blocking said bottom wall portion of said cylinder, but allow said absorbed ink to cut off the passing of air therethrough, and with a return passage for the stored jet ink being formed by said plug member and said bottom wall portion of the cylinder.

* * * * *

UNITED STATES PATENT AND TRADEMARK OFFICE

CERTIFICATE OF CORRECTION

PATENT NO. : 4,509,876

DATED : April 9, 1985

INVENTOR(S) : JIRO HORI

It is certified that error appears in the above-identified patent and that said Letters Patent is hereby corrected as shown below:

Claim 9, line 4, delete "said", insert --side--.

Signed and Sealed this

*Twentieth* Day of *August 1985*

[SEAL]

*Attest:*

DONALD J. QUIGG

*Attesting Officer* *Acting Commissioner of Patents and Trademarks*

UNITED STATES PATENT AND TRADEMARK OFFICE

CERTIFICATE OF CORRECTION

PATENT NO. : 4,509,876

DATED : April 9, 1985

INVENTOR(S) : JIRO HORI

It is certified that error appears in the above—identified patent and that said Letters Patent is hereby corrected as shown below:

Title page:

Please correct the name of the Assignee to read as follows:

-- Kotobuki & Co., Ltd., and Jiro Hori, Saitama-Ken, Japan--.

Signed and Sealed this

*Nineteenth* Day of *November 1985*

[SEAL]

*Attest:*

DONALD J. QUIGG

*Attesting Officer*

*Commissioner of Patents and Trademarks*